US009814367B2

(12) United States Patent
Shin et al.

(10) Patent No.: US 9,814,367 B2
(45) Date of Patent: Nov. 14, 2017

(54) DISHWASHER

(71) Applicant: LG ELECTRONICS INC., Seoul (KR)

(72) Inventors: Gapsu Shin, Seoul (KR); Sangheon Yoon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 281 days.

(21) Appl. No.: 14/673,346

(22) Filed: Mar. 30, 2015

(65) Prior Publication Data

US 2016/0015242 A1 Jan. 21, 2016

(30) Foreign Application Priority Data

Jul. 17, 2014 (KR) ..... 10-2014-0090338

(51) Int. Cl.
*A47L 15/42* (2006.01)

(52) U.S. Cl.
CPC ..... *A47L 15/4225* (2013.01); *A47L 15/4209* (2016.11)

(58) Field of Classification Search
None
See application file for complete search history.

(56) References Cited

U.S. PATENT DOCUMENTS 2,880,740 A 4/1959 Peglow
2011/0315174 A1* 12/2011 Pyo ..... A47L 15/4246 134/186

FOREIGN PATENT DOCUMENTS

| | | | |
|---|---|---|---|
| CN | 1679440 | A | 10/2005 |
| DE | 92 11 880 | U1 | 2/1994 |
| DE | 92 15 365 | U1 | 4/1994 |
| EP | 0 381 586 | A1 | 8/1990 |
| KR | 20-0341845 | Y1 | 2/2004 |
| KR | 10-2010-0110549 | A | 10/2010 |
| KR | 20100110549 | A * | 10/2010 |
| KR | 10-1238083 | B1 | 2/2013 |
| KR | 10-2014-0045203 | A | 4/2014 |

* cited by examiner

*Primary Examiner* — Michael Barr
*Assistant Examiner* — Cristi Tate-Sims
(74) *Attorney, Agent, or Firm* — Birch, Stewart, Kolasch & Birch, LLP

(57) ABSTRACT

A dishwasher includes a cabinet, a tub providing a washing space, a sump located below the tub and providing a space in which the washing water is stored, racks provided inside the tub and providing a space in which washing targets are received, spray arms for spraying the washing water to the racks, a pump for supplying the washing water stored in the sump to the spray arms, and at least two insulating units for connecting the pump with the sump to allow the pump to be spaced apart from a bottom of the cabinet at a predetermined distance and attenuating transfer of vibration generated in the pump to the sump.

18 Claims, 3 Drawing Sheets

【Figure 1】
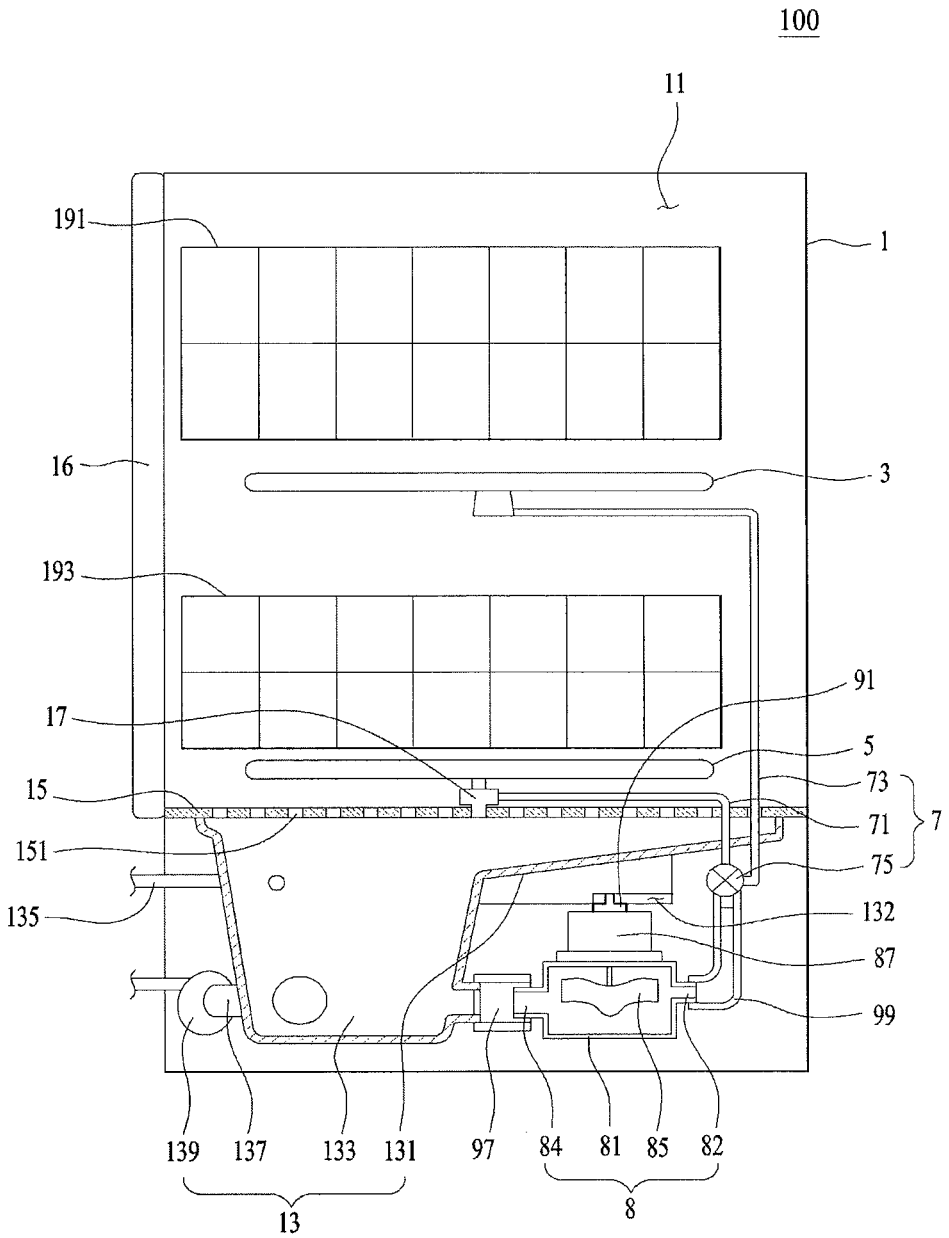

【Figure 2】
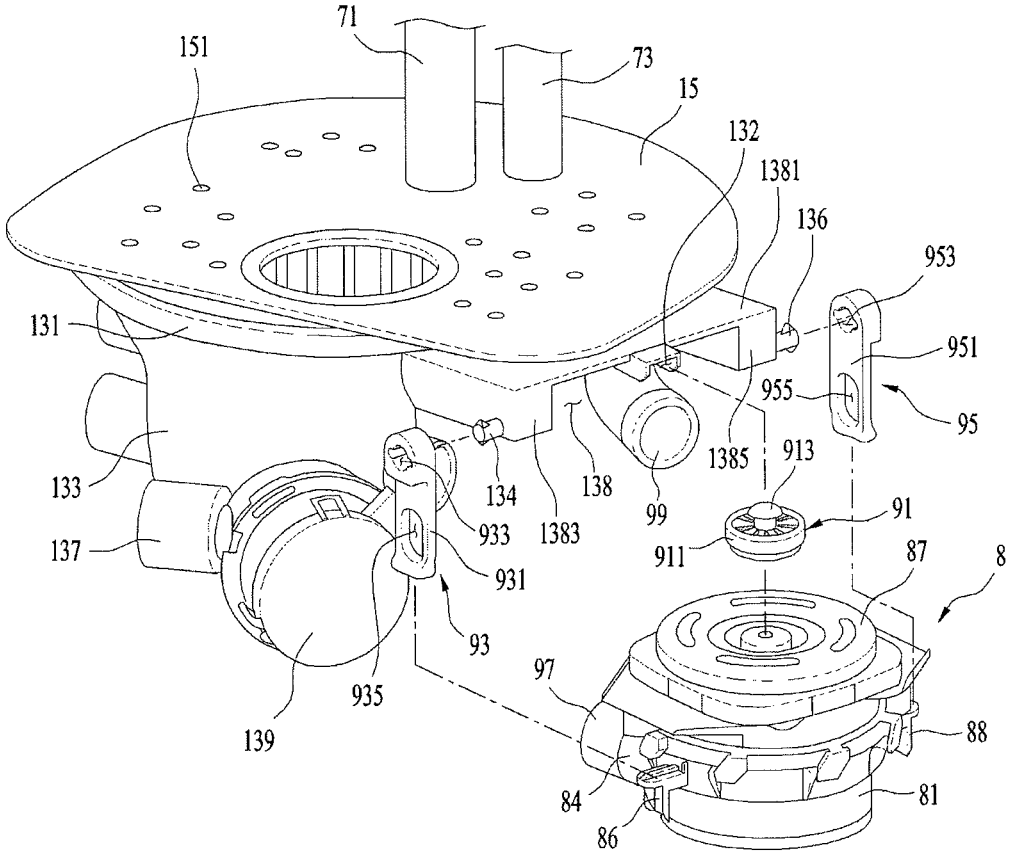

【Figure 3】
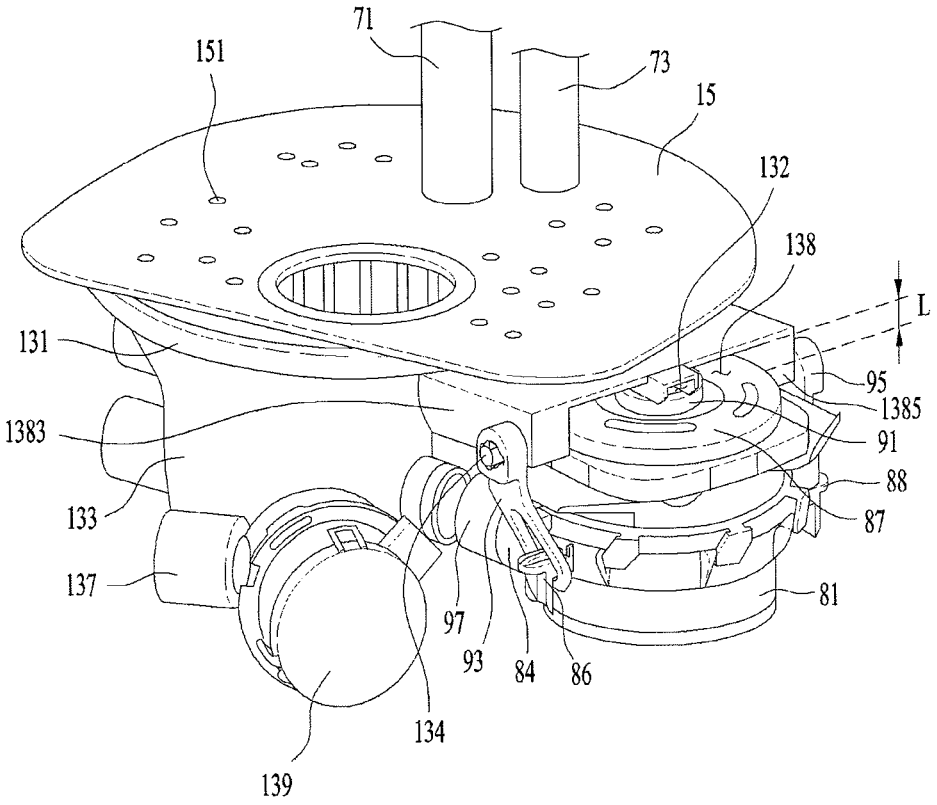

DISHWASHER

Pursuant to 35 U.S.C. §119(a), this application claims the benefit of Korean Patent Application No. 10-2014-0090338, filed on Jul. 17, 2014, which is hereby incorporated by reference in its entirety as if fully set forth herein.

BACKGROUND OF THE INVENTION

Field of the Invention

The present invention relates to a dishwasher.

Discussion of the Related Art

A dishwasher is an appliance that washes off food leftovers remaining on dishes or cooking utensils (hereinafter, referred to as a 'washing target') by using a detergent and washing water.

A dishwasher includes a tub for providing a washing space, a rack provided inside the tub, in which a washing target is received, a spray arm for spraying the washing water to the rack, a sump for storing the washing water therein, and a pump for supplying the washing water stored in the sump to the spray arm.

In a dishwasher according to the related art, vibration generated in the pump may be transferred to a cabinet or the tub. In this case, a problem may occur in that noise is caused when the vibration generated in the pump is transferred to the cabinet or the tub.

SUMMARY OF THE INVENTION

Accordingly, the present invention is directed to a dishwasher that substantially obviates one or more problems due to limitations and disadvantages of the related art.

An object of the present invention is to provide a dishwasher that may prevent vibration generated in a pump for supplying the washing water to spray arms from being transferred to the outside.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dishwasher according to the present invention comprises a cabinet; a tub for providing a washing space; a sump for providing a space in which the washing water is stored, located below the tub; racks provided inside the tub, providing a space in which washing targets are received; spray arms for spraying the washing water to the racks; a pump for supplying the washing water stored in the sump to the spray arms; and at least two insulating units for connecting the pump with the sump to allow the pump to be spaced apart from a bottom of the cabinet at a predetermined distance and attenuating transfer of vibration generated in the pump to the sump.

The insulating units may include first and second insulating units provided along a height direction of the cabinet, supporting a side of the pump towards the sump.

The sump may include a storage unit for storing the washing water therein; a cover located above the storage unit, partitioning the tub from the storage unit; a hole provided to pass through the cover, supplying the washing water to the storage unit; and a connecting unit connecting the storage unit to the cover, through which the first insulating unit and the second insulating unit are supported.

The first insulating unit and the second insulating unit may be provided to provide tension for pulling the pump in a direction of the connecting unit.

The sump may further include a receiving unit provided in the connecting unit, providing a space in which an upper surface of the pump may be received, and the insulating units support the pump to space the upper surface of the pump apart from the surface of the receiving unit at a predetermined distance.

The sump may further include first and second supporting units provided in the connecting unit, detachably supporting the first and second insulating units, and the pump further may further include first and second fastening units protruded from an outer circumference.

The first insulating unit may include a first body, a first supporting unit fastening hole provided in the first body, through which the first supporting unit is detachably inserted, and a first body slit provided in the first body, through which the first fastening unit is detachably inserted, and the second insulating unit may include a second body, a second supporting unit fastening hole provided in the second body, through which the second supporting unit is detachably inserted, and a second body slit provided in the second body, through which the second fastening unit is detachably inserted.

The first body slit is provided to have a longitudinal width of the first body in parallel with a height direction of the cabinet, to be longer than a width of a horizontal direction of the first body, and the second body slit is provided to have a longitudinal width of the second body in parallel with a height direction of the cabinet, to be longer than a width of a horizontal direction of the second body.

The insulating units may further include a third insulating unit provided between the receiving unit and the upper surface of the pump to space the receiving unit apart from the upper surface of the pump at a predetermined distance and attenuating transfer of vibration generated in the pump to the sump.

Each of the first insulating unit, the second insulating unit, and the third insulating unit may be made of an elastic material.

The insulating units may further include at least one of a fourth insulating unit guiding the washing water stored in the storage unit to the pump and attenuating transfer of vibration generated in the pump to the sump, and a fifth insulating unit guiding the washing water discharged from the pump to the spray arms and attenuating transfer of vibration generated in the pump to the spray arms.

The sump may further include a third supporting unit provided in the receiving unit, supporting the third insulating unit, and the third insulating unit includes a third body that is in contact with the upper surface of the pump, and a protrusion that is protruded from the third body, is in contact with the third supporting unit and has a sectional area smaller than that of the third body.

The third supporting unit may be provided with a groove guiding movement of the protrusion when the pump is moved by tension of the insulating units.

The third insulating unit may further include a groove provided such that a surface of the third body is bent concavely, or a plurality of holes provided to pass through the third body.

The storage unit is protruded towards a lower portion of the cover and has a sectional area smaller than an area of the cover, and the insulating units support the pump to allow the pump to be located at a lower space of the cover, in which the storage unit is not provided.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a view illustrating a dishwasher according to the present invention;

FIG. 2 is an exploded view illustrating a sump, a pump and an insulator; and FIG. 3 is a view illustrating a coupling structure of a sump and a pump.

DETAILED DESCRIPTION OF THE INVENTION

Reference will now be made in detail to the preferred embodiments of the present invention, examples of which are illustrated in the accompanying drawings. Meanwhile, it is to be understood that a configuration of an apparatus, which will be described hereinafter, or method for controlling the same are not intended to restrict the scope of the present invention but are intended to describe the embodiment of the present invention. Wherever possible, the same reference numbers will be used throughout the drawings to refer to the same or like parts.

As shown in FIG. 1, a dishwasher 100 according to the present invention includes a cabinet 1 constituting an external appearance of the dishwasher 100, a tub 11 located inside the cabinet 1 and providing a washing space, racks 191 and 193 provided inside the tub 11 and providing a space in which washing targets are received, spray arms 3 and 5 for spraying the washing water toward the racks 191 and 193, a sump 13 for returning the washing water sprayed into the tub 11, and a pump 8 for supplying the washing water stored in the sump 13 to the spray arms 3 and 5.

The racks 191 and 193 may be considered an upper rack 191 (or first rack) and a lower rack 193 (or second rack) located below the upper rack.

The cabinet 1 is provided with a door 16 for opening and closing the tub 11. The upper rack 191 and the lower rack 193 may be configured to be removable from the cabinet when the door 16 opens the tub 11.

A rail (not shown) for guiding movement of the racks 191 and 193 into and out of the tub 11 is provided in an inner side of the tub 11. The racks 191 and 193 may be provided with a roller (not shown) for supporting the racks 191 and 193 on the rail.

The sump 13 includes a storage unit 133 in which the washing water is stored, a cover 15 located above the storage unit 133 to partition the tub 11 from the storage unit 133, and a connecting unit 131 connecting the storage unit 133 to the cover 15.

The cover 15 is provided with a plurality of holes 151 passing through the cover 15, permitting the washing water to enter the storage unit 133.

The holes 151 may be provided in an area of the cover 15 located only above the storage unit 133, or may be provided in the full area of the cover 15 to supply the washing water inside the tub 11 to the connecting unit 131.

The connecting unit 131 may be tilted at a predetermined angle toward the storage unit 133 to guide the washing water entered through the holes 151 to the storage unit 133.

The tub 11 is located at a space above the cover 15. This permits the washing water sprayed into the tub 11 through the spray arms 3 and 5 to return to the storage unit 133 through the holes 151 and the connecting unit 131 without any separate unit.

The cover 15 may have a shape corresponding to an inner space of the cabinet 1, and the connecting unit 131 is fixed to the lower portion of the cover 15.

The connecting unit 131 may fully surround the lower space of the cover 15 (a plane area of the cover is the same as that of a body), or may surround only a space in which the holes 151 are located.

The storage unit 133 may be provided in such a manner that the cover 15 may be bent concavely towards a bottom of the cabinet 1. The storage unit 133 preferably has a sectional area smaller than an area of the connecting unit 131, and that the connecting unit 131 is downwardly tilted toward the storage unit 133.

If the storage unit 133 has a sectional area smaller than the area of the connecting unit 131 and the storage unit 133 is not provided at the area below the connecting unit 131, the pump 8 may be located at an area below the connecting unit 131 so that a volume of the dishwasher 100 may be minimized.

The storage unit 133 is supplied with the washing water through a water supply path 135 connected to a water supply source (not shown). The washing water stored in the storage unit 133 is discharged out of the cabinet 1 through a drainage path 137 and a drainage pump 139.

The spray arms 3 and 5 may be considered a lower spray arm 5 for washing the washing targets provided inside the tub 11 and received in the lower rack 193, and an upper spray arm 3 for washing the washing targets received in the upper rack 191.

The lower spray arm 5 and the upper spray arm 3 are supplied with the washing water through the pump 8 and a supply path 7. The supply path 7 includes a first supply path 71 connected to the lower spray arm 5, a second supply path 73 connected to the upper spray arm 3, and a switching valve 75 selectively opening the respective supply paths 71 and 73.

If the lower spray arm 5 is provided rotatably inside the tub 11, the lower spray arm 5 may be rotatably coupled to a holder 17 provided in the cover 15, and the first supply path 71 may be provided to supply the washing water to the holder 17.

If the upper spray arm 3 is provided rotatably inside the tub 11, the upper spray arm 3 may be rotatably coupled to the second supply path 73.

The pump 8 includes a housing 81 provided with an impeller 85, an inlet 84 through which the washing water flows into the housing 81, an outlet 82 through which the washing water inside the housing 81 is discharged out of the housing 81, and a motor 87 provided outside the housing 81 for rotating the impeller 85.

The inlet 84 is connected to the storage unit 133 through an inlet connecting pipe 97. The outlet 82 is connected to the switching valve 75 through an outlet connecting pipe 99.

When the motor 87 is supplied with power and the impeller 85 is rotated, the water supplied from the sump 13 to the housing 81 moves to the switching valve 75 through the outlet 82, and the water supplied to the switching valve 75 is supplied to the upper spray arm 3 or the lower spray arm 5 along the supply paths 71 and 73 opened by the switching valve 75.

The pump 8 is fixed in the cabinet 1 by insulating units 91, 93 and 95. The insulating units 91, 93 and 95 attenuate vibration generated in the pump 8 and prevent the vibration from being transferred to the sump 13 and the cabinet 1.

Two or more insulating units are preferably provided for spacing the outer surface of the pump 8 from the bottom of the cabinet 1 at a predetermined distance, and spacing the outer surface of the pump 8 from the sump 13 at a predetermined distance.

As shown in FIG. 2, a first insulating unit 93 and a second insulating unit 95 are provided for spacing a bottom of the pump 8 from the bottom of the cabinet 1 at a predetermined distance. A third insulating unit 91 may further be provided in addition to the first and second insulating units 93 and 95 for spacing an upper surface of the pump 8 from the sump 13 at a predetermined distance.

Since the motor 87 for rotating the impeller 85 provided inside the housing 81 is located on the upper surface of the pump 8, the third insulating unit 91 maintains the spacing between the motor 87 and the sump 13.

Also, the first insulating unit 93 and the second insulating unit 95 maintain the spacing between the bottom of the housing 81 forming the lower surface of the pump 8 and the bottom of the cabinet.

The third insulating unit 91 includes a third body 911 contacting the upper surface of the motor 87, and a protrusion 913 protruded from the third body 911, being in contact with any one of the connecting unit 131 of the sump and the cover 15.

FIG. 2 illustrates that the third insulating unit 91 is in contact with the connecting unit 131. In this case, the connecting unit 131 is preferably further provided with a receiving unit 138 for providing a space in which the upper surface of the pump may be received.

The receiving unit 138 includes a receiving body 1381 protruded from the connecting unit 131 and arranged in parallel with the bottom of the cabinet 1, and first and second flanges 1383 and 1385 protruded from the receiving body 1381 towards the bottom of the cabinet 1 and spaced apart from each other at a predetermined distance.

Moreover, the receiving unit 138 further includes a third supporting unit 132 through which the protrusion 913 is supported, to support the third insulating unit 91. The third supporting unit 132 is provided in such a manner that the surface of the receiving body 1381 is bent concavely toward the cover 15, or protruded from the surface of the receiving body 1381 toward the bottom of the cabinet to provide a space in which the protrusion 913 may be received.

The third supporting unit 132 is preferably provided at the corner of the receiving unit 138 toward the storage unit 133 to guide movement of the protrusion 913 when the pump 8 is installed. The third supporting unit 132 may be provided to guide movement of the pump 8 when the pump 8 is moved by tension of the first and second insulating units 93 and 95.

The third insulating unit 91 may be made of any material that attenuates vibration of the motor 87, for example, an elastic member such as rubber.

The protrusion 913 preferably has a sectional area smaller than that of the third body 911 to minimize transfer of vibration of the motor 87 to the sump 13.

If the third body 911 includes a hole passing through the third body 911 or a groove arranged along the circumference of the protrusion 913 such that the surface of the third body 911 is bent concavely, the vibration attenuation effect of the third body 911 may be increased.

The first insulating unit 93 includes a first body 931 having one end connected to the connecting unit 131 and the other end connected to the housing 81. The first body 931 may also be made of any material that attenuates vibration generated in the pump 8, for example, an elastic member such as rubber.

A first supporting unit 134 and a first fastening unit 86, which are coupled to the first body 931, are provided in the connecting unit 131 and the housing 81, respectively. FIG. 2 illustrates an example where the first body 931 is detachably coupled to the receiving unit 138 located at the connecting unit 131. In this case, the first supporting unit 134 is provided in the first flange 1383 which forms the receiving unit 138.

The first body 931 may be coupled to the first supporting unit 134 or the first fastening unit 86 using various structures. In FIGS. 2 and 3, the first supporting unit 134 is protruded from the outer circumference of the receiving unit 138, and the first fastening unit 86 is protruded from the housing 81.

The first body 931 includes a first supporting unit fastening hole 933 to which the first supporting unit 134 is inserted, and a first body slit 935 to which the first fastening unit 86 is inserted.

Preferably, the first body slit 935 passes through the first body 931, and has a longitudinal (height direction of the cabinet) length longer than a horizontal width (width direction of the cabinet) of the first body 931 in order to facilitate assembly of the first body 931 and the first fastening unit 86.

The second insulating unit 95 includes the same structure as that of the first insulating unit 93. That is, the second insulating unit 95 includes a second body 951 made of a material that attenuates vibration, a second supporting unit fastening hole 953 provided in the second body 951, and a second body slit 955.

A second supporting unit 136 to which the second supporting unit fastening hole 953 is inserted is provided on the outer circumference (the second flange 1385) of the receiving unit 138, and a second fastening unit 88 protruded from the housing 81 and inserted to the second body slit 955 is provided in the pump 8.

Preferably, the second body slit 955 passes through the second body 951, and has a longitudinal (height direction of the cabinet) length longer than a horizontal width (width direction of the cabinet) of the second body 951.

Although the first insulating unit 93, the second insulating unit 95 and the third insulating unit 91 are described to fix the pump 8 to the receiving unit 138, the insulating units 91, 93 and 95 in the present invention may be provided to fix the pump 8 to the cover 15.

In the dishwasher 100 having the aforementioned structure, vibration of the pump 8 may also be transferred to the sump 13 or the cabinet 1 through an inlet connecting pipe 97 connecting the pump 8 with the storage unit 133 and an outlet connecting pipe 99 connecting the pump 8 with the switching valve 75.

Therefore, each of the inlet connecting pipe 97 and the outlet connecting pipe 99 is preferably made of a material (elastic member) that absorbs vibration. In this case, the inlet connecting pipe 97 and the outlet connecting pipe 99 serve as a fourth insulating unit and a fifth insulating unit, respectively.

The dishwasher having the aforementioned structure fixes the pump 8 to the sump 13 as follows.

As shown in FIG. 2, a worker fixes the first insulating unit 93 to the receiving unit 138 by inserting the first supporting unit fastening hole 933 onto the first supporting unit 134, and fixes the second insulating unit 95 to the receiving unit 138 by inserting the second supporting unit fastening hole 953 onto the second supporting unit 136.

Since each of the first insulating unit 93 and the second insulating unit 95 is made of a material for vibration attenuation, such as rubber, the worker pulls the first body 931 and the second body 951 to connect the first body slit 935 and the second body slit 955 onto the first fastening unit 86 and the second fastening unit 88 of the housing 81, respectively.

Afterwards, the worker couples the third insulating unit 91 mounted on the upper surface of the motor 87 to the third supporting unit 132. In this case, the third supporting unit 132 will guide movement of the protrusion 913 of the third insulating unit 91. Therefore, if the worker locates the protrusion 913 in the third supporting unit 132, the pump 8 will be moved to a preset location and fixed to the sump 13 as shown in FIG. 3 in accordance with elasticity (tension of the first and second insulating units for pulling the pump in a direction of the sump) of the first insulating unit 93 and the second insulating unit 95 and guided by the third supporting unit 132.

As shown in FIG. 3, the upper surface of the pump 8 is spaced from the surface of the receiving unit 138 at a predetermined distance L that is sufficient to provide for the tension applied to the pump 8 by the first insulating unit 93 and the second insulating unit 95.

According to the dishwasher 100 of the present invention having the aforementioned structure, because vibration of the pump 8 may be prevented from being transferred to the sump 13 or the cabinet 1, noise and vibration of the dishwasher is reduced. Also, because the pump 8 is located at a lower space of the connecting unit 131 and where the storage unit 133 is not provided, a volume of the dishwasher may be minimized.

As described above, the present invention provides a dishwasher 100 that prevents vibration, which is generated in the pump 8 for supplying the washing water to the spray arms 3 and 5, from being transferred from the pump 8 to components external to the pump 8.

It will be apparent to those skilled in the art that the present invention can be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed is:

1. A dishwasher comprising:

a cabinet;

a tub providing a washing space;

a sump located below the tub and providing a space in which washing water is stored;

a rack located inside the tub and configured to receive washing targets;

a spray arm configured to spray the washing water to the rack;

a pump configured to supply the washing water stored in the sump to the spray arm; and a first insulating unit and a second insulating unit connecting the pump to the sump so that the pump is spaced apart from a bottom of the cabinet by a predetermined distance, the first insulating unit and the second insulating unit being configured to attenuate a transfer of vibration generated by the pump to the sump, wherein the sump includes:

a storage unit for storing the washing water therein;

a cover located above the storage unit, the cover partitioning the tub from the storage unit;

a hole passing through the cover for permitting the washing water to pass into the storage unit; and a connecting unit connecting the storage unit to the cover, the connecting unit supporting the first insulating unit and the second insulating unit, wherein the connecting unit includes a receiving unit providing a space in which an upper surface of the pump is received, and wherein the first insulating unit and the second insulating unit support the pump such that an upper surface of the pump is spaced from the receiving unit by a predetermined distance.

2. The dishwasher according to claim 1, wherein the first insulating unit and the second insulating unit extend along a height direction of the cabinet, and support a side of the pump so that the pump is biased toward the sump.

3. The dishwasher according to claim 1, wherein the first insulating unit and the second insulating unit are configured to provide tension for pulling the pump in a direction toward the connecting unit.

4. The dishwasher according to claim 1, wherein the connecting unit includes a first supporting unit detachably supporting the first insulating unit, and a second supporting unit detachably supporting the second insulating unit, and wherein the pump further includes a first fastening unit and a second fastening unit protruded from an outer surface of the pump.

5. The dishwasher according to claim 4, wherein the first insulating unit includes:

a first body;

a first supporting unit fastening hole located in the first body and through which the first supporting unit is detachably inserted; and a first body slit located in the first body and through which the first fastening unit is detachably inserted; and wherein the second insulating unit includes:

a second body;

a second supporting unit fastening hole located in the second body and through which the second supporting unit is detachably inserted; and a second body slit located in the second body and through which the second fastening unit is detachably inserted.

6. The dishwasher according to claim 5, wherein the first body slit has a length parallel with the height direction of the cabinet that is longer than a width of the first body in a horizontal direction, and wherein the second body slit has a length parallel with the height direction of the cabinet that is longer than a width of the second body in a horizontal direction.

7. The dishwasher according to claim 1, further comprising a third insulating unit located between the receiving unit and the upper surface of the pump so that the receiving unit is spaced apart from the upper surface of the pump by a predetermined distance, the third insulating unit being configured to attenuate a transfer of vibration generated by the pump to the sump.

8. The dishwasher according to claim 7, wherein each of the first insulating unit, the second insulating unit, and the third insulating unit is made of an elastic material.

9. The dishwasher according to claim 7, further comprising:

a fourth insulating unit configured to guide the washing water stored in the storage unit to the pump, the fourth insulating unit being configured to attenuate a transfer of vibration generated by the pump to the sump; and a fifth insulating unit configured to guide the washing water discharged from the pump to the spray arms, the fifth insulating unit being configured to attenuate a transfer of vibration generated by the pump to the spray arms.

10. The dishwasher according to claim 7, wherein the receiving unit further includes a third supporting unit configured to support the third insulating unit, and wherein the third insulating unit includes:

a third body contacting the upper surface of the pump; and a protrusion protruded from the third body, the protrusion contacting the third supporting unit and having a sectional area smaller than that of the third body.

11. The dishwasher according to claim 10, wherein the third supporting unit includes a groove configured to guide movement of the protrusion when the pump is moved by tension of the first insulating unit and the second insulating unit.

12. The dishwasher according to claim 10, wherein the third insulating unit further includes a groove therein such that a surface of the third body is bent concavely.

13. The dishwasher according to claim 10, wherein the third insulating unit further includes a plurality of holes therein passing through the third body.

14. The dishwasher according to claim 1, wherein the storage unit is protruded downwardly of the cover and has a sectional area smaller than an area of the cover, and wherein the first insulating unit and the second insulating unit support the pump at a location below the cover and where the storage unit is not located.

15. A dishwasher comprising:

a cabinet;

a tub providing a washing space;

a sump located below the tub and providing a space in which washing water is stored;

a rack located inside the tub and configured to receive washing targets;

a spray arm configured to spray the washing water to the rack;

a pump configured to supply the washing water stored in the sump to the spray arm; and a first vibration attenuation member, a second vibration attenuation member and a third vibration attenuation member all connecting the pump to the sump so that the pump is spaced apart from a bottom of the cabinet by a predetermined distance, the first vibration attenuation member, the second vibration attenuation member and the third vibration attenuation member being configured to attenuate a transfer of vibration generated by the pump to the sump, wherein the sump includes a receiving member providing a space where an upper surface of the pump is received, wherein the first vibration attenuation member and the second vibration attenuation member support the pump such that an upper surface of the pump is spaced from the receiving member by a predetermined distance, and wherein the third vibration attenuation member is located between the receiving member and the upper surface of the pump so that the receiving member is spaced apart from the upper surface of the pump by a predetermined distance.

16. The dishwasher according to claim 15, wherein the first vibration attenuation member and the second vibration attenuation member are made of an elastic material and provide tension for pulling the pump in a direction toward the sump.

17. The dishwasher according to claim 16, wherein the receiving member includes a supporting member configured to support the third vibration attenuation member, and wherein the supporting member includes a groove configured to guide movement of the third vibration attenuation member when the pump is moved by tension of the first vibration attenuation member and the second vibration attenuation member.

18. The dishwasher according to claim 15, further comprising:

a fourth vibration attenuation member configured to guide the washing water stored in the sump to the pump, the fourth vibration attenuation member being configured to attenuate a transfer of vibration generated by the pump to the sump; and a fifth vibration attenuation member configured to guide the washing water discharged from the pump to the spray arms, the fifth vibration attenuation member being configured to attenuate a transfer of vibration generated by the pump to the spray arms.

* * * * *